US005546713A

United States Patent [19]

Voegele, Jr. et al.

[11] Patent Number: 5,546,713

[45] Date of Patent: Aug. 20, 1996

[54] OVERLAPPING FRAMING SYSTEM FOR GLAZING ELEMENTS

[75] Inventors: William P. Voegele, Jr., Pittsburgh, Pa.; Douglas A. Ramsey, Delray Beach, Fla.; Alan D. Lohr; Carl E. Kamphaus, both of Pittsburgh, Pa.

[73] Assignee: Extech/Exterior Technologies, Inc., Pittsburgh, Pa.

[21] Appl. No.: 421,374

[22] Filed: Apr. 13, 1995

[51] Int. Cl.[6] ..... E06B 3/26

[52] U.S. Cl. ..... 52/202; 52/235; 52/204.597; 52/90.1

[58] Field of Search ..... 52/202, 235, 208, 52/204.597, 204.591, 204.62, 204.63, 508, 476, 456, 460, 461, 463, 90.1, 93.1, 93.2, 770, 771, 772, 775, 781

[56] References Cited

U.S. PATENT DOCUMENTS 3,035,446 5/1962 Ross ..... 52/781 X
3,990,196 11/1976 Eddins ..... 52/456 X
5,040,347 8/1991 Valvis ..... 52/235 X

FOREIGN PATENT DOCUMENTS 100737 2/1962 Netherlands ..... 52/770
2139686 11/1984 United Kingdom ..... 52/202

*Primary Examiner*—Carl D. Friedman
*Assistant Examiner*—Timothy Kang
*Attorney, Agent, or Firm*—J. Stewart Brams

[57] ABSTRACT

A framing system is provided for supporting glazing elements on a substrate, such as a building framework or an existing glazing system. The framing system includes a plurality of frames surrounding and supporting respective glazing elements. A plurality of frame members are joined to form sides of each frame. Each frame member includes a rabbet for receiving the glazing element having a pair of spaced sides and a base connecting said spaced sides, and a flange extending outwardly from the rabbet base. Flanges of frame members overlap with flanges of adjacent frame members of adjacent frames. Fasteners extend through the flanges for attaching the framing system to the substrate.

14 Claims, 5 Drawing Sheets

OVERLAPPING FRAMING SYSTEM FOR GLAZING ELEMENTS

BACKGROUND OF THE INVENTION

1. Field of the Invention

The present invention relates to framing systems for supporting glazing elements over a substrate, more particularly to a framing system designed for attachment over an existing glazing system or structural framework.

2. Brief Description of the Prior Art

A trend has begun in the glazing industry wherein glazing systems, which include frames supporting glazing elements for windows, skylights, curtainwalls, etc., are being reinforced with a secondary overlaying glazing system. These extra protective systems are needed to resist damage from flying debris and high pressure differentials caused by inclement weather. However, unique problems are encountered in the installation of a secondary glazing system over an existing framing system. For example, the frames of the secondary system must be assembled and fastened such that the fasteners do not contact and break the glazing elements (e. g., glass) of the underlying system. Additionally, the width of the individual frame members of the secondary system need to be minimized so as not to unduly restrict the line of sight. These and other problems arise which are particular to the design and installation of a secondary glazing system.

An object of the present invention is to provide a framing system for use in a primary or secondary glazing system which addresses the problems associated with a secondary glazing system. Another object of the present invention is to provide a framing system made up of a plurality of frame members which overlap with adjacent frame members. A further object of the present invention is to provide a framing system which is easily installed over a metal tubing or wood structural substrate as well as over an existing glazing system. Another object of the present invention is to provide a secondary glazing system which will straddle the fasteners of the original glazing system over which it is applied to minimize the thickness of the secondary glazing system. Another object of the present invention is to provide a framing system with concealed fasteners.

SUMMARY OF THE INVENTION

In accordance with the present invention, a framing system is provided for supporting glazing elements on a substrate, such as a building or an existing glazing system. The framing system includes a plurality of frames which surround and support glazing elements. Each frame includes a plurality of frame members joined to form sides of the frame. Each frame member typically includes a rabbet for receiving the glazing element, the rabbet having a pair of spaced sides and a base connecting the spaced sides, and a flange extending outwardly from the base. Flanges of frame members overlap with flanges of adjacent frame members of adjacent frames. Fasteners extend through the flanges for attaching the framing system to the substrate.

In one embodiment of the present invention the thickness of the framing system is minimized and is equal to the thickness of one framing element. In a preferred embodiment, each frame member is an identically shaped extruded member. A pair of inwardly extending gaskets may be attached to the inner sides of each rabbet for securing and sealing the glazing element. A sealing gasket may be provided between overlapping flanges. In a preferred embodiment, a leg extends from an end of each flange and is spaced from the base, whereby a channel is formed by the leg, flange, and a portion of the base. For each pair of identical overlapping frame members, a channel on one frame member faces inwardly toward the substrate and the channel on the other frame member faces outwardly away from the substrate. A cap member may be received in each outwardly facing channel. A pair of notches are in each channel, one notch in the leg and one notch in the portion of the base. The cap member includes a top with spaced sides extending from the top and projections on the sides for engaging the pair of notches. Each frame further includes coupling clips for connecting the frame members of the frame together. Each rabbet further includes a pair of nubs extending from the sides forming a groove for receiving one coupling clip.

These and other advantages of the present invention will be clarified in the following description taken together with the attached figures wherein like reference numerals represent like elements throughout.

DETAILED DESCRIPTION

Figure 1:
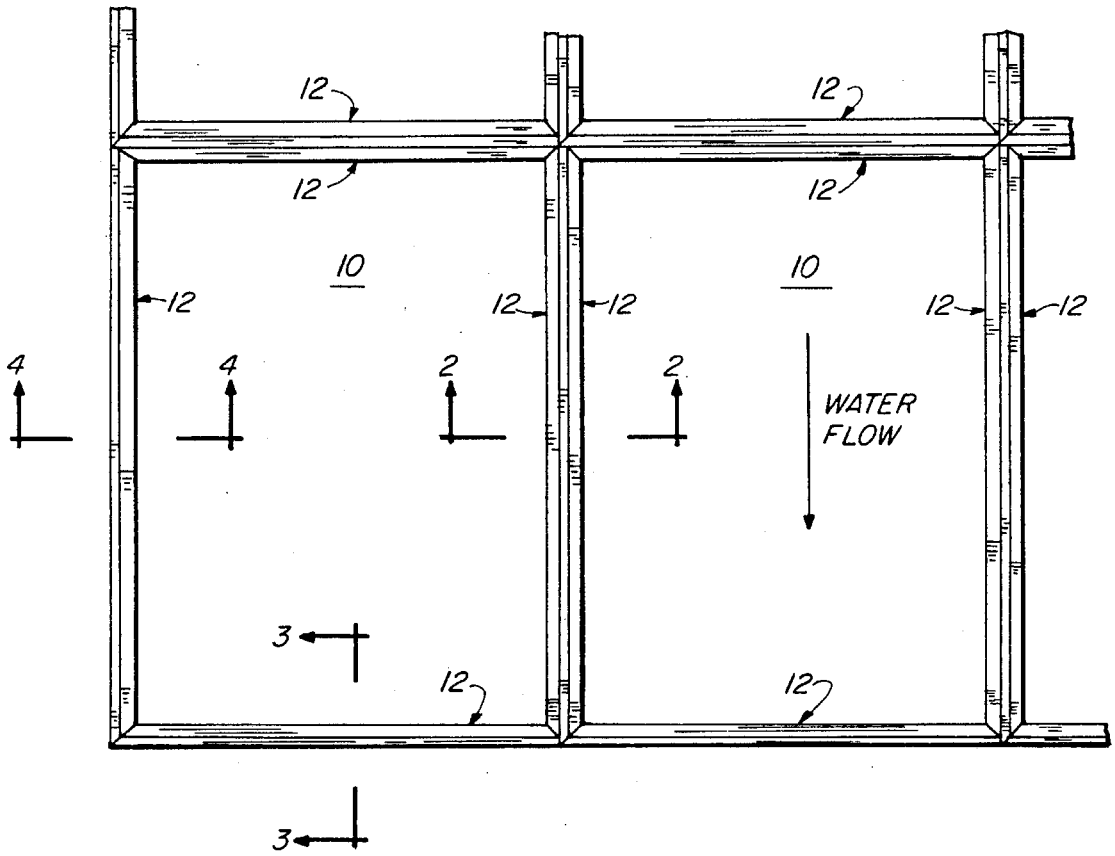
FIG. 1 is a plan view of a portion of a framing system for glazing according to the present invention.

FIG. 1 illustrates a glazing system including a plurality of glazing elements 10 supported by a framing system according to the present invention. The glazing elements may be made of glass or plastic, including monolithic or cellular acrylic or polycarbonate, or other appropriate materials as are known by those skilled in the art. The glazing system is installed on a substrate. Suitable substrates include a building framework or an existing glazing system.

The framing system comprises a plurality of rectangular frames. The frames may be formed in other shapes such as squares, triangles, etc., as appropriate or aesthetically desired, provided the shape of the frames correspond to the shape of the glazing elements 10. Each frame includes a plurality of frame members 12 joined together to form sides of the frame. The frame members 12 are generally aluminum extrusions, and in a preferred embodiment of the present invention the frame members 12 are identical to each other. The use of identically shaped frame members 12 reduces the manufacturing costs and simplifies the on-site construction of the framing system.

Individual frames may be formed in such a way that frame members 12 which join at the corners of the frame may face the same or opposite directions with respect to the substrate. This formation will assist in the onsite construction of the framing system. When overlapping frame members are identical, overlapping frame members of adjacent frames preferably face opposite directions with respect to the substrate.

Figure 2:
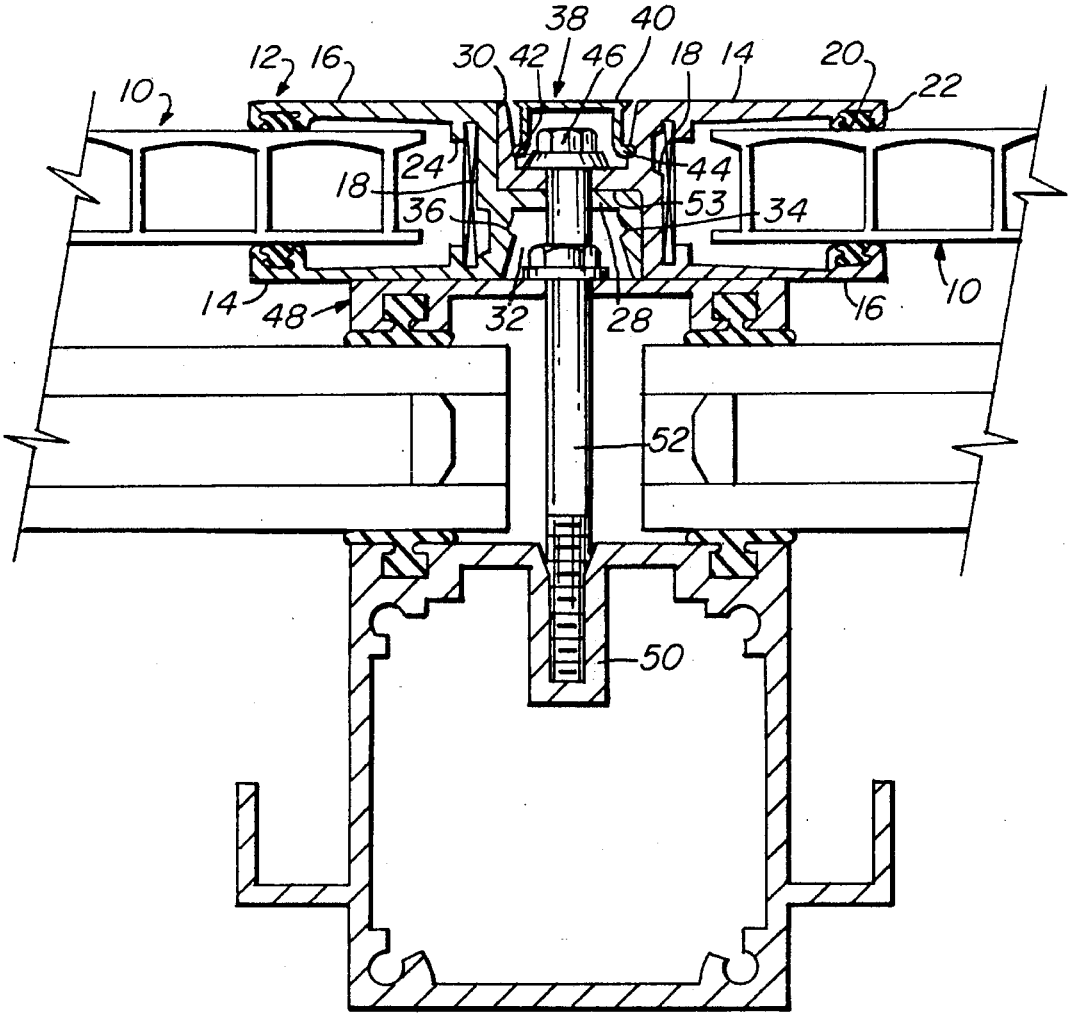
FIG. 2 is a section view of the framing system shown in FIG. 1 taken along line 2—2.
Figure 3:
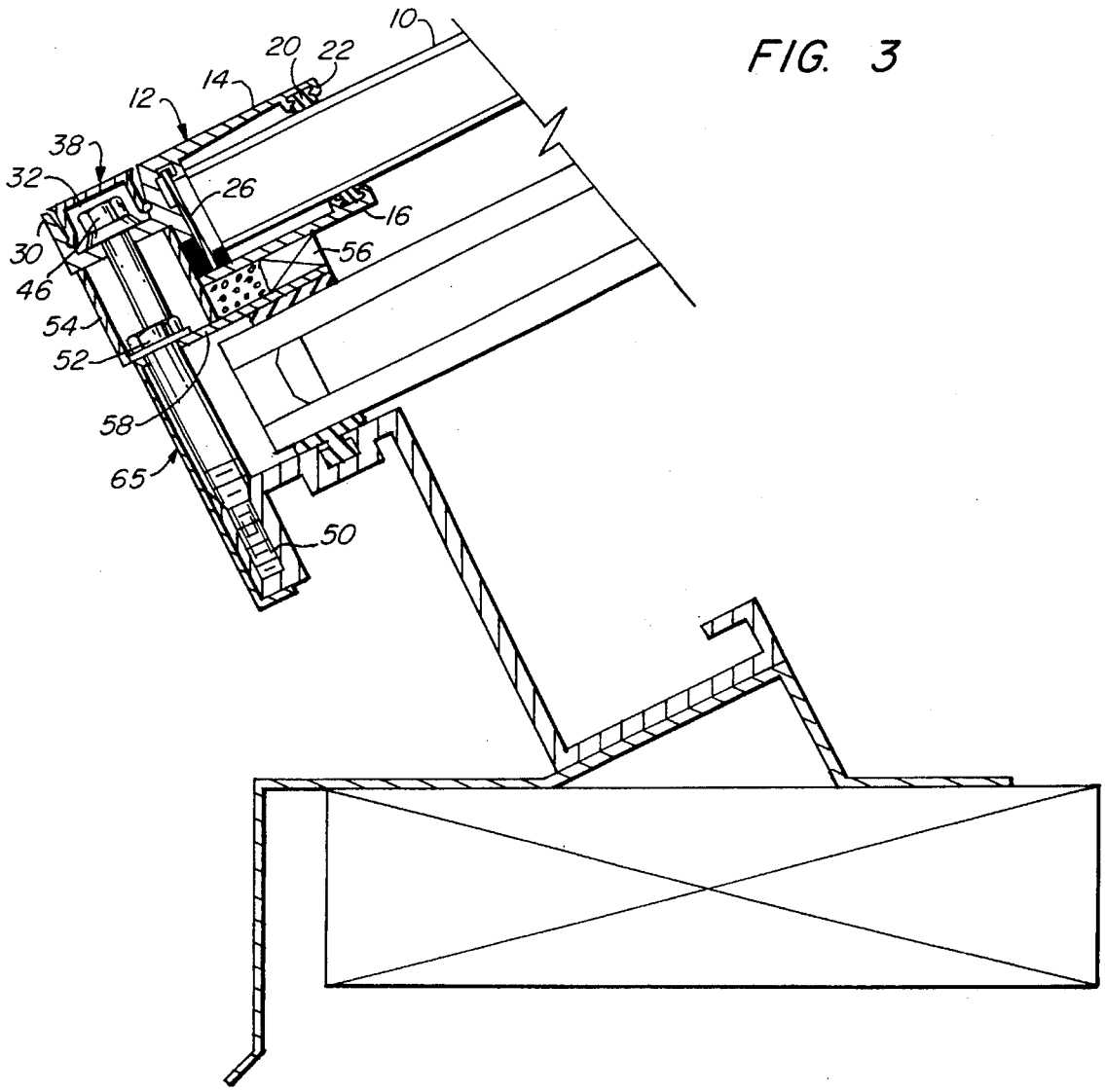
FIG. 3 is a section view of the framing system shown in FIG. 1 taken along line 3—3.
Figure 4:
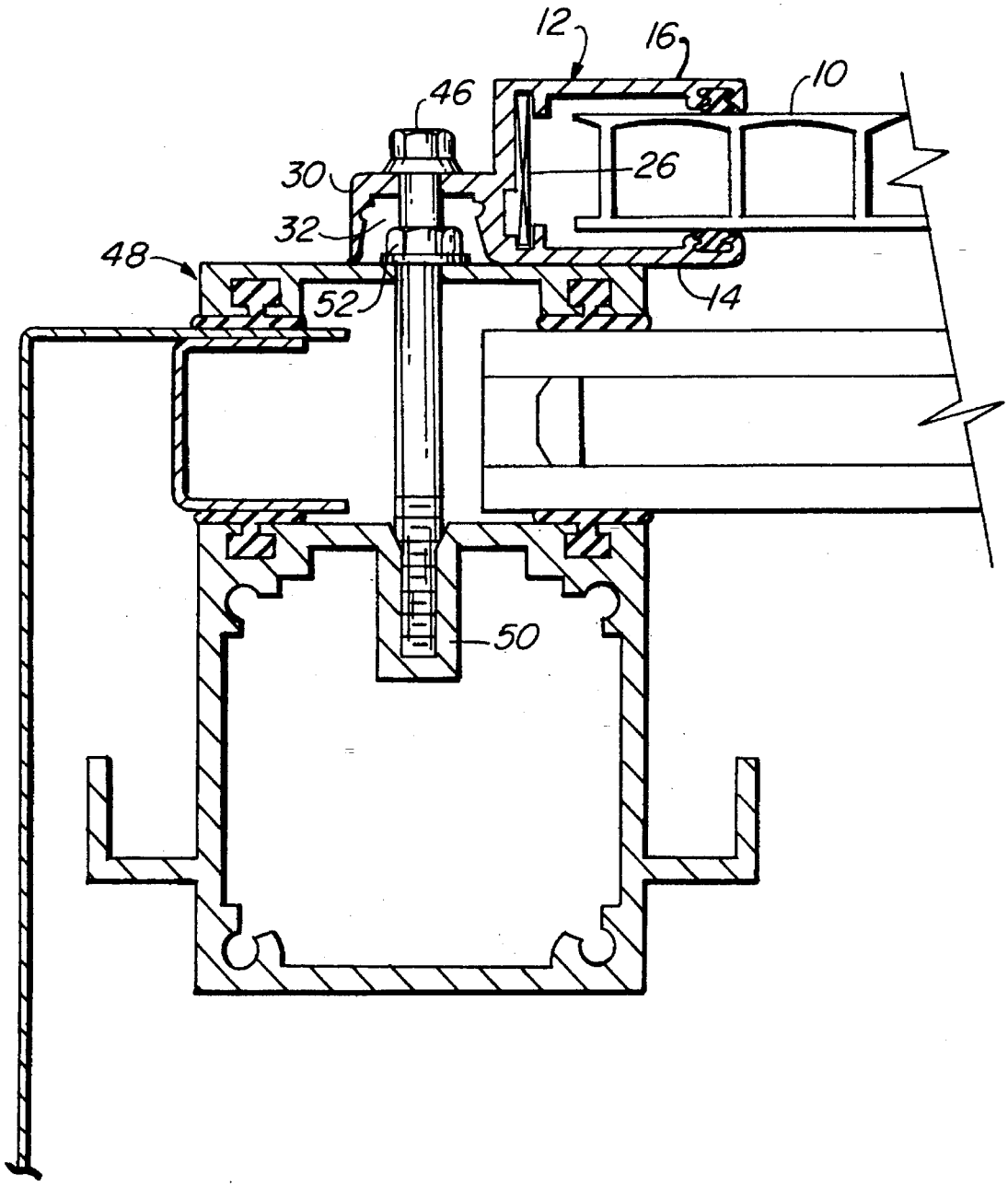
FIG. 4 is a section view of the framing system shown in FIG. 1 taken along line 4—4.

As shown in FIGS. 2 to 4, each frame member 12 includes a rabbet for receiving the glazing element 10. The rabbet includes a pair of parallel, spaced sides 14 and 16 and a base 18 connecting the spaced sides 14 and 16. A pair of gaskets 20 extend into the rabbet and are received in locking ridges 22 formed on the sides 14 and 16. The gaskets 20 may be made of any suitable materials as are known to those skilled in the art such as elastomeric materials, and are preferably coated with a relatively low friction material. The gaskets 20 engage, secure, and seal the glazing element 10. Additional, secondary gaskets (not shown) may be provided to more securely hold the glazing element 10 in position.

Figure 6:
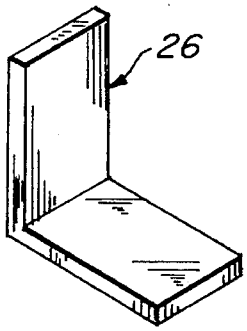
FIG. 6 is a perspective view of a corner coupling clip.

A pair of nubs 24 extend into the rabbet from sides 14 and 16 forming a groove for receiving a corner coupling clip 26, shown in FIG. 6. The coupling clips 26 are generally solid aluminum clips formed at a 90 degree angle, sized to matingly fit within the groove formed by the nubs 24 thereby connecting a mitered 90 degree intersection between two frame members 12 of a rectangular frame. The corner coupling clips 26 may be formed at other angles as necessary depending on the shape of the glazing element and frame.

A substantially flat flange 28 extends away from the base 18 substantially perpendicular thereto. One surface of the flange 28 is positioned about midway along the base 18. A leg 30 extends away from an end of the flange so as to be spaced from the base 18. Leg 30 is positioned substantially parallel to the base 18, whereby a channel 32 is formed by the leg 30, the flange 28, and a portion of the base 18.

A pair of notches 34 and 36 are formed in the channel 32, one notch 34 in the leg 30 and one notch 36 in the portion of the base 18. A cap member 38, typically an aluminum or plastic extrusion, is received in each channel 32 which faces away from the substrate. Cap member 38 includes a top 40 with spaced sides 42 extending from the top 40. Projections 44 are provided on the sides 42 for engaging with the pair of notches 34 and 36 to hold the cap member 38 in place.

Screw fasteners 46 extend through the flanges 28 into the substrate for attaching the framing system thereto. Where the substrate is an existing glazing system 48 the fasteners 46 can thread into a screw channel 50 formed for attaching the existing glazing system 48. The fasteners 46 must be offset from the fasteners 52 of the existing glazing system 48.

As best illustrated in FIG. 2, the frame members 12 are configured to overlap and nest together. Flanges 28 of frame members 12 of a frame overlap with flanges 28 of adjacent frame members 12 of an adjacent frame, whereby the channel 32 of one frame member 12 of the adjacent frame members faces inwardly toward the substrate and the channel 32 of the other frame member 12 faces outwardly away from the substrate. As shown in FIG. 2, the channels 32 of overlapping frame members 12 face in opposite directions. The overlapping arrangement reduces the line-of-sight width of the mating adjacent frames. Additionally the overlapping construction will add to the structural integrity of the overall framing system. A foam sealing gasket 53 is provided between overlapping flanges 28 to form an air and water seal between the frame members 12.

FIG. 3 illustrates a typical frame member 12 configuration and orientation for an outer edge of a framing system 65, such as at the side or preferably at the bottom of a skylight or wall. The frame member 12 is oriented with the channel 32 facing away from the substrate, with protective cap member 38 covering the channel 32. Spacer 54 and shim 56 may underlie the frame member 12 near the screw fastener 46 to elevate the frame member 12. The frame member 12 may be elevated sufficiently to provide an air space between the frame member 12 and the substrate. The air space serves to accommodate outflow of moisture, if needed, and inflow of air to minimize condensation. An open cell venting tape 58, which may be PVC or other suitable material, may also be installed between the frame member 12 and the substrate to provide a filtering media minimizing the entry of dirt and insects.

FIG. 4 illustrates another typical frame member 12 configuration and orientation for an outer edge of a framing system, preferably a side edge. The frame member 12 is oriented with the channel 32 facing toward the substrate, without protective cap member 38. This orientation allows the framing system to straddle existing fasteners 52 and thus abut against an existing glazing system 48 to minimize the extent to which the framing system extends from the substrate. No spacers or shims are shown in this orientation. In this orientation, together with the overlapping and nesting of adjacent frames, the thickness of the framing system measured perpendicularly from the substrate may be equal to the thickness of one frame member 12.

Figure 5:
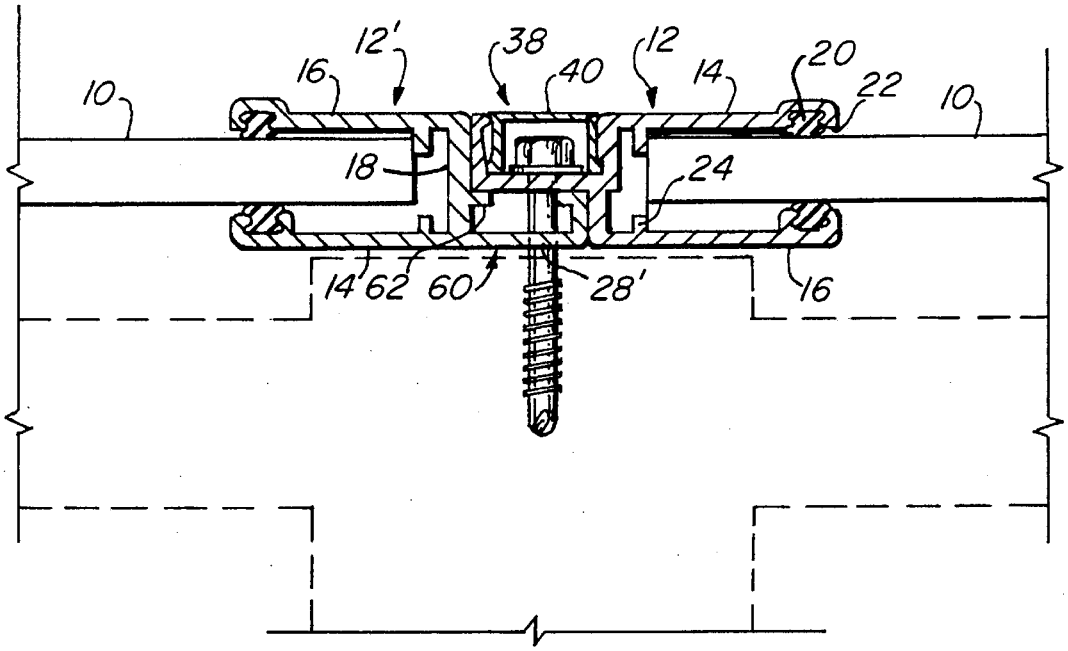
FIG. 5 is a section view similar to that shown in FIG. 2, of the framing system according to a second embodiment of the present invention.

FIG. 5 is a view similar to that shown in FIG. 2, and illustrates a framing system according to a second embodiment of the present invention. This second embodiment is the same as the first embodiment described above, except that the overlapping frame members are not identical. In the overlapping frame members the frame member 12 with the outwardly facing channel 32 is identical to the frame member 12 described above in FIGS. 1–4. The other frame member 12' includes a channel shaped extension 60 extending from a lower portion of the base 18 of the frame member 12'. Extension 60 includes an upper flange 62 and a lower flange 28' extending from the base 18 aligned with side 14 of frame member 12' and side 16 of frame member 12. This embodiment further enhances the structural integrity of the framing system.

Although the present invention has been described with particularity, it will be apparent to those of ordinary skill in the art at the time the invention was made that various modification may be made to the described invention without departing from the spirit or scope thereof. Accordingly, the scope of the present invention is intended to be defined by the following claims.

We claim:

1. A framing system for supporting glazing elements on a substrate, said framing system comprising:

a plurality of frames, each frame surrounding and supporting one glazing element, each frame including a plurality of frame members joined to form sides of said frame;

each frame member including a rabbet for receiving said glazing element having a pair of spaced sides and a base connecting said spaced sides, and a flange extending outwardly from said base of said rabbet;

said flanges of said frame members overlapping with said flanges of adjacent ones of said frame members of adjacent frames;

each said flange having a leg spaced from the respective said base and extending from an end of the respective said flange whereby a channel is formed by said leg, said flange and portion of said base:

said channel on one frame member of each pair of over lapping frame members facing inwardly toward said substrate and said channel on the other of said frame members facing outwardly away from said substrate; and fasteners extending through said flanges for attaching said framing system to said substrate.

2. The framing system of claim 1 wherein the thickness of said framing system measured perpendicularly from said substrate is equal to the thickness of one framing element.

3. The framing system of claim 1 wherein each frame member is an identically shaped extruded member.

4. The framing system of claim 1 further including a pair of extending gaskets attached to said sides of each rabbet and extending into each rabbet for securing and sealing said glazing element.

5. The framing system of claim 1 further including a sealing gasket between overlapping flanges.

6. The framing system of claim 1 further including a cap member received in each said outwardly facing channel.

7. The framing system of claim 6 further including a pair of notches in each said channel, one said notch in said leg and one said notch in said portion of said base, and wherein each said cap member includes a top with spaced sides extending from said top and projections on said sides for engaging said pair of notches.

8. The framing system of claim 1 wherein said substrate is an existing glazing system.

9. The framing system of claim 1 wherein each frame further includes corner coupling clips for connecting said frame members of said frame together.

10. The framing system of claim 9 wherein each rabbet further includes a pair of hubs extending from said sides forming a groove for receiving one said coupling clip.

11. A framing system for supporting glazing elements on a substrate, said framing system comprising:

a plurality of frames, each frame surrounding and supporting one glazing element, each frame including a plurality of identical, extruded frame members joined to form sides of said frame, and corner coupling clips for connecting said frame members together at corners of said frame;

each said frame member including a rabbet for receiving said glazing element having a base and a pair of parallel, spaced sides connected to said base and extending in a given direction therefrom, a pair of nubs extending from said sides of said rabbet forming a groove for receiving one said corner coupling clip, a pair of inwardly extending gaskets attached to said sides of said rabbet for securing said glazing element, a flange extending from said base substantially perpendicular thereto, in a direction generally opposite said given direction, a top surface of said flange positioned about midway along said base, a leg spaced from said base and extending from an end of said flange, said leg substantially parallel to said base, whereby a channel is formed by said leg, said flange and a portion of said base, a pair of notches in said channel, one notch in said leg and one notch in said portion of said base;

wherein flanges of frame members overlap with flanges of adjacent frame members of adjacent frames, whereby the thickness of said framing system measured perpendicularly from said substrate is equal to the thickness of one said frame member, and wherein said channel of one frame member of said adjacent frame members faces inwardly toward said substrate and said channel of the other frame member faces outwardly away from said substrate whereby said channels face in opposite directions;

a sealing gasket between overlapping flanges;

a cap member received in each said outwardly facing channel, each said cap member including a top with spaced sides extending from said top and projections on said sides for engaging said pair of notches; and fasteners extending through said connecting flanges for attaching said framing system.

12. A framing system for supporting glazing elements adapted to be installed over an existing glazing system, said framing system comprising:

a plurality of extruded frame members which nest together with adjacent frame members in an overlapping fashion to form joint frames;

a plurality of screw fasteners which pass through said joint frames and are adapted to pass through frame members of the existing glazing system by threading into screw holding tracks of the existing glazing system.

13. The framing system of claim 12 wherein each frame member includes a channel which is adapted to be positioned over the fasteners of the existing glazing system.

14. The framing system of claim 13 further including spacer elements for ventilating space between the framing system and the substrate.

* * * * *